US006047721A

United States Patent [19]

Roche

[11] Patent Number: 6,047,721

[45] Date of Patent: Apr. 11, 2000

[54] AIR INTRODUCTION DEVICE FOR A HYDRO-PNEUMATIC RESERVOIR

[76] Inventor: Emile Roche, 248 Allée de la Grange-Maman, F-01000 Saint-Denis-les-Bourg, France

[21] Appl. No.: 09/124,978

[22] Filed: Jul. 30, 1998

[30] Foreign Application Priority Data

Aug. 1, 1997 [FR] France ..... 97 09902

[51] Int. Cl.[7] ..... F04F 1/18

[52] U.S. Cl. ..... 137/207; 137/211

[58] Field of Search ..... 137/207, 211

[56] References Cited

U.S. PATENT DOCUMENTS

| | | | |
|---|---|---|---|
| 2,524,770 | 10/1950 | Conery | 137/211 |
| 2,705,457 | 4/1955 | Le Van | 137/211 |
| 2,708,881 | 5/1955 | Carpenter | 137/211 |
| 2,756,762 | 7/1956 | Nash | 137/211 |
| 2,918,931 | 12/1959 | Siri | 137/211 |
| 2,938,464 | 5/1960 | Nielsen | 137/211 |
| 3,195,464 | 7/1965 | Shetler | 137/211 |
| 3,225,696 | 12/1965 | Brigman | 137/211 |
| 3,347,256 | 10/1967 | Massey et al. . | |
| 4,182,358 | 1/1980 | Sinelnikov et al. . | |
| 5,647,392 | 7/1997 | Roche | 137/207 |

FOREIGN PATENT DOCUMENTS

| | | |
|---|---|---|
| 0617227 | 9/1994 | European Pat. Off. . |
| 2416417 | 8/1979 | France . |

*Primary Examiner*—Gerald A. Michalsky
*Attorney, Agent, or Firm*—Smith, Gambrell & Russell, LLP

[57] ABSTRACT

Device 7 for introducing air into a hydraulic system comprising a hydro-pneumatic reservoir 3 mounted on a pipe 1. The air introduction device 7 is mounted in such fashion as to introduce air into an area of the system containing water in which the pressure $P_s$ is either below or slightly above atmospheric pressure. The device is active when a lack of air is to be made good in the hydro-pneumatic reservoir 3.

20 Claims, 3 Drawing Sheets

AIR INTRODUCTION DEVICE FOR A HYDRO-PNEUMATIC RESERVOIR

The present invention concerns a device for introducing air into a hydro-pneumatic reservoir equipping a hydraulic pipe which can be part of a distribution network of drinking water or irrigation water, for example, or a network for removal of waste water or chemical liquids.

A hydro-pneumatic reservoir can operate as a regulator (or hydrophoric) reservoir to regulate the pumping pressure and to assure continuity of service in the pipe within a pressure range between a high level and a low level. If the high pressure level is exceeded the pump (or one of the pumps) feeding the pipe is stopped. The regulation reservoir then tops up the water in the pipe. When the low level is reached the pump is restarted to assure a sufficient pressure and a sufficient flowrate in the pipe.

A hydro-pneumatic reservoir can also be used as an anti-ramming reservoir on a hydraulic pipe to compensate the effects of depressurisation and over pressurisation caused by stopping a pump or shutting a valve, for example. The operation of a reservoir of the above kind is known in particular from French patent No 2 416 417 (ROCHE).

Correct operation of a hydro-pneumatic reservoir necessitates maintaining as constant as possible a quantity of air inside the reservoir. In use the hydro-pneumatic reservoir contains water or any other liquid flowing in the pipe and air trapped in the reservoir above the surface of the water or liquid. The air can dissolve in the liquid and so vary the quantity of air trapped in the reservoir. It is therefore necessary to introduce air into the reservoir in the event of insufficiency.

To prevent contact between the air and the liquid and thereby to prevent the air from dissolving bladders are sometimes used that have drawbacks of cost and even of fragility, in particular for installations of large size and employing high pressures, of head loss on draining them because of the inclusion of a grid to prevent extrusion of the bladder, and of the necessity to monitor the inflation of the device with air. The use of air compressors may also be mentioned. However, these are not recommended for drinking water networks because of the risk of the presence of oil in the injected air and are relatively costly.

The aim of the invention is to overcome the drawbacks of the systems mentioned above by proposing a simple air introduction device that is low in cost, consumes little energy and does not modify the hydraulic functioning of the installation.

The air introduction device of the invention is for a hydraulic system comprising a hydro-pneumatic reservoir mounted on a pipe. The air introduction device is mounted in such fashion as to introduce the air into an area of the system containing water in which the pressure is close to atmospheric pressure, that is to say below atmospheric pressure or slightly above atmospheric pressure. The device is active only when a lack of air is registered in the hydro-pneumatic reservoir. The energy required to introduce air is therefore low, even virtually nil in some cases.

The device comprises an air feed tube equipped with air introduction monitoring means.

In one embodiment of the invention the air introduction device is mounted on the pipe between a water offtake and a pump.

In another embodiment of the invention the pipe is provided with depressurising means upstream of the hydro-pneumatic reservoir, the air feed tube being connected to said depressurising means.

In another embodiment of the invention the air introduction device comprises a branch tube connected to a part of the hydro-pneumatic reservoir containing water, an auxiliary pump mounted on the branch tube and depressurising means mounted downstream of the auxiliary pump, the air feed tube being connected to said depressurising means.

The depressurising means advantageously comprise a venturi tube. The venturi tube provides a liquid pressure that is locally lower than atmospheric pressure. Other depressurising means are feasible: diaphragm, etc.

In one embodiment of the invention the air introduction device comprises an electric valve and an adjuster valve or an air introduction flowrate limiter disposed on the air feed tube.

In one embodiment of the invention the air introduction device is mounted upstream of a pump, the air feed tube discharging into the low pressure area of the pump. The low pressure area is the part of the pump where, in use, air can be injected and where the pressure of the stream of liquid is minimal or close to the minimum.

In a variant, the air feed tube can discharge into the inlet strainer of the pump.

The air introduction device comprises a small compressor mounted on the air feed tube if the pressure $P_s$ is higher than atmospheric pressure. $P_s$ is the absolute pressure in the air introduction area: pump strainer, pump low-pressure area, inlet pipe on the upstream side of the pump, etc.

In a preferred embodiment of the invention the pressure $P_s$ is less than atmospheric pressure and the compressor is not required.

The invention also consists in a pump equipped with an air introduction device and a hydro-pneumatic reservoir equipped with an air introduction device.

By virtue of the invention, air can be introduced into a hydro-pneumatic reservoir with low or very low consumption of energy and using a very simple device of low cost.

The invention will be better understood and other advantages will become apparent from the detailed description of a few embodiments given by way of non-limiting example and illustrated by the accompanying drawings, in which.

Figure 1:
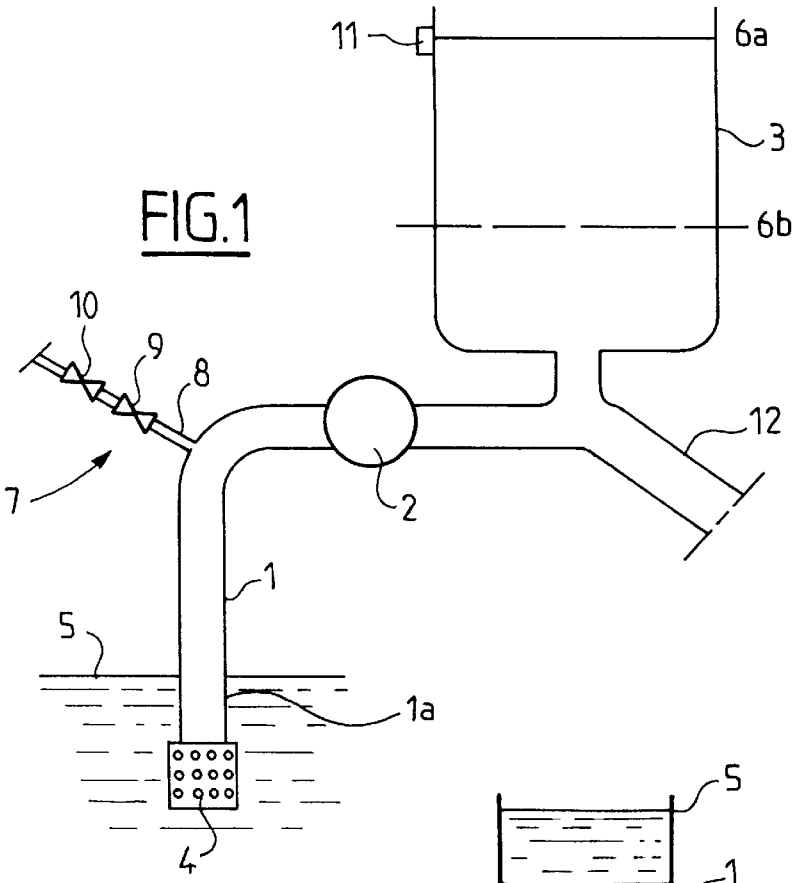
FIG. 1 is a diagram showing a hydraulic system provided with an air introduction device of the invention.

As can be seen in FIG. 1 the hydraulic system comprises a pipe 1 provided with a pump 2 and with a hydro-pneumatic reservoir 3 disposed on the pipe 1 downstream of the pump 2 and serving as a regulation reservoir or an anti-ramming reservoir. The upstream end 1*a* of the pipe 1 is equipped with a strainer 4 and with a valve, not shown, for taking up water or any other liquid from a tank 5.

In the case of a regulation reservoir, and considering only one of the many situations that can arise, the hydro-pneumatic reservoir 3 is used to adapt the liquid flowrate in the pipe 1 to the needs of users. When the liquid in hydro-pneumatic reservoir 3 reaches a top level 6*a* the pump 2 is stopped and the hydro-pneumatic reservoir 3 is progressively emptied by supplying the liquid to the pipe 1. When the liquid in the hydro-pneumatic reservoir 3 reaches the low level 6*b* the pump 2 is restarted to provide the flowrate in the pipe 1 and to refill the hydro-pneumatic reservoir 3. Another use of the hydro-pneumatic reservoir is as an anti-ramming reservoir, as already indicated.

Correct operation of the hydro-pneumatic reservoir 3 requires that a relatively constant quantity of air be present inside it. However, the air in the hydro-pneumatic reservoir 3 tends to dissolve in the liquid.

An air introduction device 7 is therefore provided on the pipe 1 between the strainer 4 and the pump 2. It comprises a tube 8 one end of which is open to the atmosphere and the other end of which discharges into the pipe 1, an electric valve 9 and an air flowrate limiter device 10, for example an air introduction adjustment valve, both disposed on the air feed tube 8. The electric valve 9 is connected to a lack of air detector 11 disposed on the hydro-pneumatic reservoir 3. The lack of air detector can be a level detector, for example, but other systems are feasible.

Only when a lack of air is to be made good in the hydro-pneumatic reservoir 3 and the pump 2 is operating, the electric valve 9 is open, which causes air to be introduced into the pipe 1 via the tube 8 upstream of the pump 2. The pressure $P_s$ in the portion of the pipe 1 delimited by the pump 2 and the strainer 4 is below atmospheric pressure because of the aspiration of the pump 2 and because the latter is higher than the water surface. The air introduced in this way then enters the pump 2 and then the hydro-pneumatic reservoir 3.

To prevent degrading the operating characteristics of the pump 2 the quantity of air introduced is limited to a small fraction, for example a few percent, of the liquid flowrate in the pipe 1. This adjustment is effected by means of the adjuster valve 10. To guarantee that all the air introduced into the pipe 1 enters the hydro-pneumatic reservoir 3, an air trap 12 can be provided at the base of the hydro-pneumatic reservoir 3. The air trap 12 can consist of a pipe portion sloping downwards in the downstream direction.

Introduction of air is therefore effected by means of a simple, low-cost device which requires energy only to actuate the electric valve 9.

Figure 2:
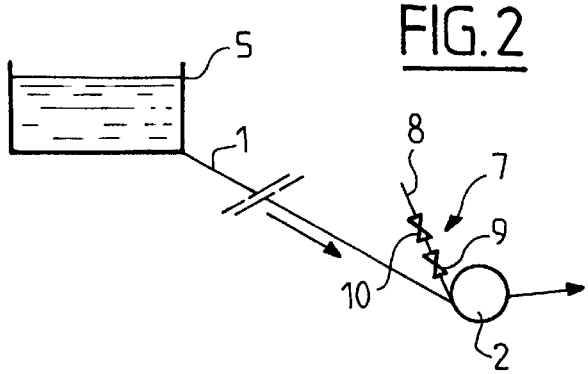
FIG. 2 is a diagram showing another hydraulic system with an air introduction device at the inlet of a pump.

In FIG. 2 the tank 5 is at a higher level than the pump 2. The air introduction device 7 is then disposed in the immediate proximity of the pump 2, the air feed tube 8 discharging into the low-pressure area of the pump 2 to exploit the fact that the pressure $P_s$ there is below atmospheric pressure.

Figure 3:
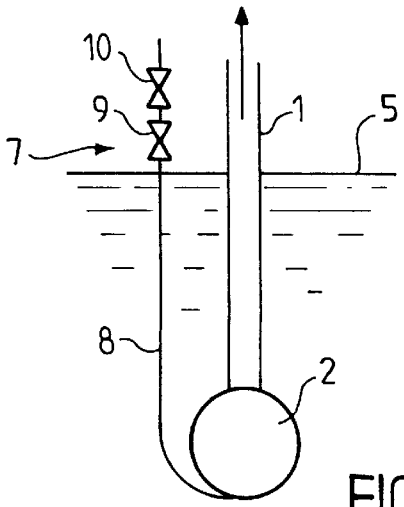
FIG. 3 is a diagram showing a hydraulic system provided with a submerged pump, the air introduction device being mounted on the pump.

In FIG. 3 the pump 2 is of the submerged type. The air introduction device 7 again has the tube 8 discharging into the low-pressure area of the pump 2 to exploit the fact that the pressure $P_s$ there is below atmospheric pressure.

Of course, the air introduction device operates in the same fashion with one pump or with a plurality of pumps disposed in parallel. A single device can be provided for more than one pump, the tube 8 then having branches to each pump downstream of the electric valve 9 and the adjuster valve 10 (FIGS. 1, 2, 3) or each of them can be equipped with an electric valve to prevent compressed air reaching the strainers of the pumps that are stopped (FIGS. 4, 5 and possibly 6).

Figure 4:
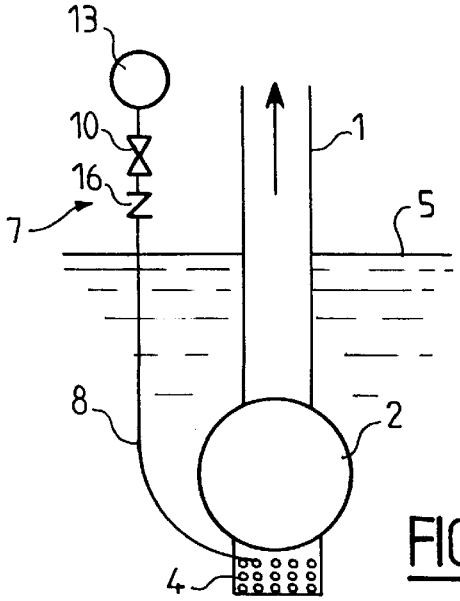
FIG. 4 is a variant of FIG. 3.

In FIG. 4 the pump 2 is submerged. The air feed tube 8 of the air introduction device 7 discharges into the strainer 4 of the pump 2. The pressure $P_s$ in the strainer 4 is slightly above atmospheric pressure. The air introduction device 7 is therefore provided with an air compressor 13 disposed upstream of the adjuster valve 10 and capable of generating a slight pressure increase over the pressure $P_s$ in the strainer 4 less atmospheric pressure plus the head losses in the device. A pressure rise in the order of a few tenths of a bar may be necessary, for example.

Figure 5:
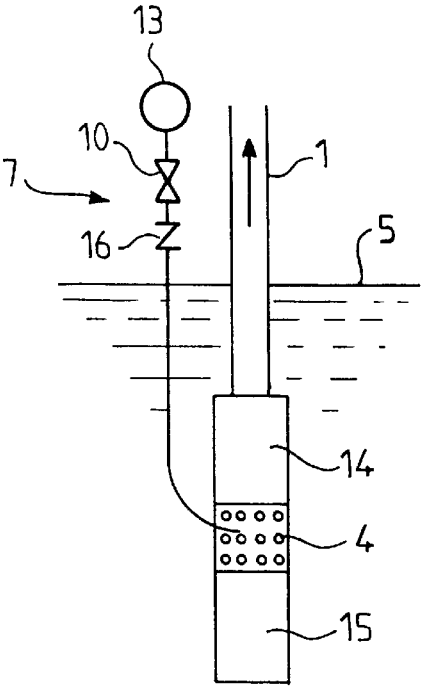
FIG. 5 is another variant of FIG. 3.

FIG. 5 shows a variant similar to FIG. 4 in which the pump 2 is replaced by a submerged electropump unit comprising a pump 14 and a drive motor 15. In FIGS. 4 and 5 the electric valve is not necessary because the introduction of air is effected by starting and stopping the compressor 13. The compressor 13 operates only when it is necessary to compensate a lack of air in the hydro-pneumatic reservoir and when the pump is operating. The air feed tube 8 can be fitted with a valve 16.

Figure 6:
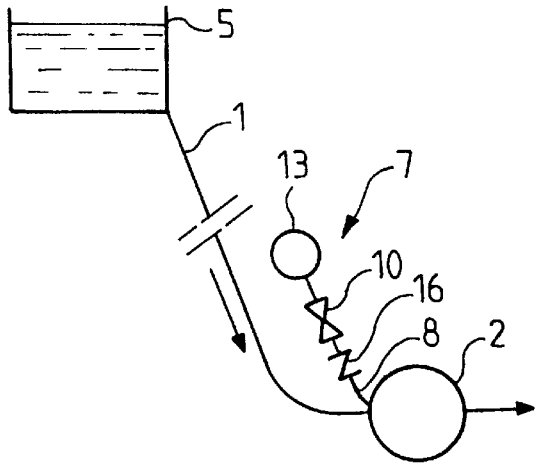
FIG. 6 is a variant of FIG. 2.

FIG. 6 shows a hydraulic system identical to that of FIG. 2 but in which the air introduction device is similar to that from FIG. 4 because $P_s$ is above atmospheric pressure. The air introduction device is provided with a compressor 13 and its tube 8 discharges immediately at the inlet of the pump 2 or (which is better) into the low-pressure area of the pump 2, which reduces the value of $P_s$. The compressor 13 can be equipped with a buffer, not shown, if its flowrate would otherwise be too high. The valve 16 or an electric valve 9 is indispensable in this case to prevent return flow of liquid to the compressor 6 when the pump 2 and the compressor are stopped.

Figure 7:
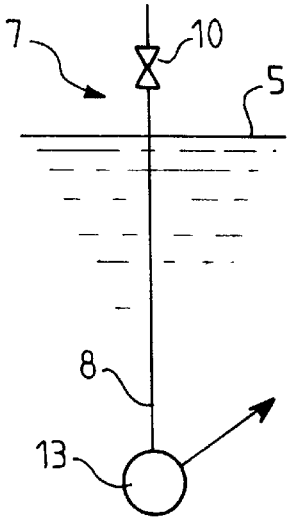
FIG. 7 is a diagram showing a submerged compressor air introduction device.

In FIG. 7 the air introduction device 7 is provided with a submerged compressor 13, the adjuster valve 10 being in the open air, upstream of the compressor 13 on the air feed tube 8. The air feed tube 8 is connected to a strainer or to the low-pressure area of a submerged pump, not shown.

Figure 8:
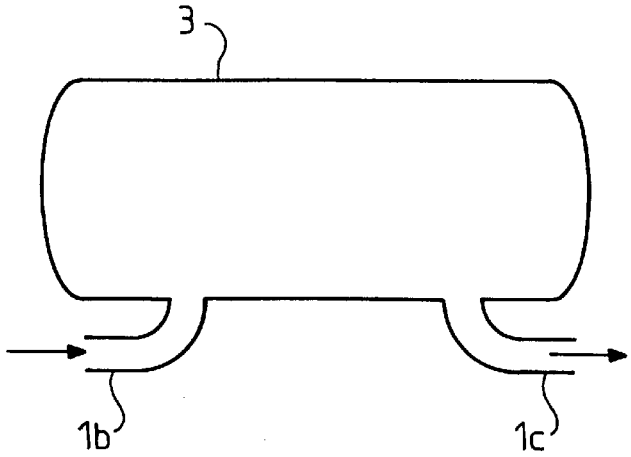
FIG. 8 is a side elevation view of a hydro-pneumatic reservoir.

In FIG. 8 the hydro-pneumatic reservoir 3 is disposed in an elongate position and is connected to an upstream pipe portion 1*b* and to a downstream pipe portion 1*c*. As the two pipe portions 1*b* and 1*c* discharge directly into the hydro-pneumatic reservoir 3 without being connected to each other, the air arriving via the upstream pipe portion 1*b* is guaranteed to remain in the hydro-pneumatic reservoir 3 and is not sent into the downstream pipe portion 1*c*. An equivalent system can be provided for a vertical hydro-pneumatic reservoir, the pipe portions 1*b* and 1*c* then terminating in the domed bottom of the reservoir.

Other types of air trap are feasible, in particular those described in European patent No. 93 400 771.7.

In some cases, in particular for hydro-pneumatic reservoirs installed at a great distance from a pump, and for introducing air into them when they are at a pressure higher than atmospheric pressure, a depressurising system is provided directly on the pipe 1 or on a branch therefrom to create an area in which the working pressure $P_s$ is below atmospheric pressure.

Figure 9:
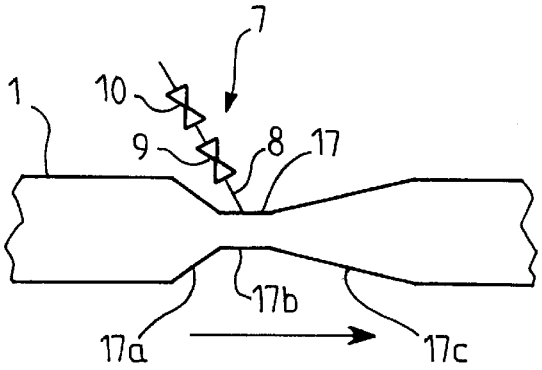
FIG. 9 is a diagram showing a pipe equipped with an air introduction device of the invention.

In FIG. 9, a venturi tube 17 which forms a constriction is disposed in the pipe 1. The venturi tube 17 comprises a convergent portion 17*a*, a cylindrical portion 17*b* and a divergent portion 17*c*. The working pressure $P_s$ in the cylindrical portion 17*b* is much lower than the pressure in the remainder of the pipe 1. The venturi pipe 17 is dimensioned so that the pressure $P_s$ is below atmospheric pressure.

The air introduction device 7 comprises an air feed tube 8 communicating with the cylindrical portion 17*b*, an electric valve 9 and an adjuster valve 10. In this way air can be introduced into a pipe at a high pressure when the electric valve 9 is open.

Figure 10:
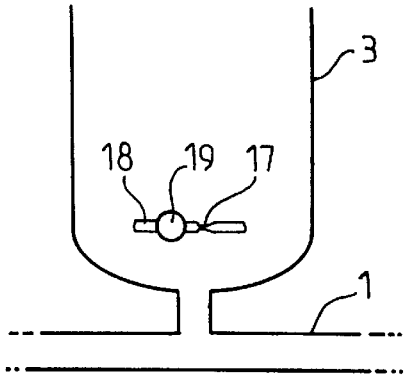
FIGS. 10 and 11 are diagrams showing a hydro-pneumatic reservoir equipped with an air introduction device of the invention.
Figure 11:
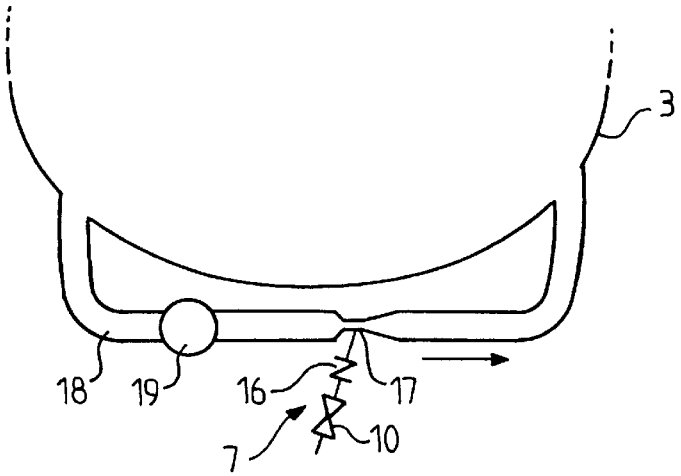

In an advantageous variant, a branch tube 18 can be provided both ends of which are connected to the hydro-pneumatic reservoir 3 in a portion of the latter that always contains water (FIGS. 10 and 11). The branch tube 18 is provided with a low-power auxiliary pump 19 that is able to withstand the high pressures in the hydro-pneumatic reservoir, a venturi tube 17 downstream of the auxiliary pump 19 and an air introduction device 7 connected to the venturi tube 17.

When a lack of air is to be made good in the hydro-pneumatic reservoir the pump 19 is started to circulate liquid in the branch tube 18. The venturi tube 17 creates an area in which the working pressure $P_s$ is below atmospheric pressure. The air introduction device 7 provided with an air feed tube 8, a valve 16 and an adjuster valve 10 allows air to enter as long as the pump 19 is running. When the pump is stopped, the valve 16 is closed by the pressure of the liquid and introduction of air is stopped.

The "in line" auxiliary pump 19 is merely for creating sufficient circulation in the tube 18. Its pressure head can therefore be low and represent only a small fraction of that of the pumps of the pumping station or of the pressure in the hydro-pneumatic reservoir.

The valve 16 can be replaced by an electric valve 9 open only when the auxiliary pump 19 is running.

The system can operate regardless of the state of the pump or pumps of the pumping station: running or stopped.

Figure 12:
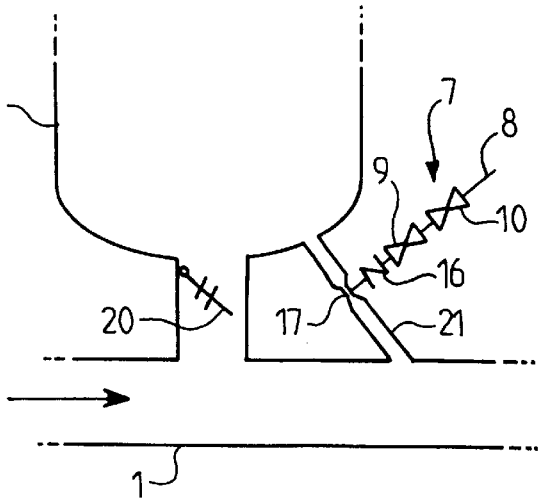
FIG. 12 is a diagram showing a variant in which the air introduction device is disposed between the pipe and the hydro-pneumatic reservoir.

In FIG. 12 the hydro-pneumatic reservoir 3, generally of the anti-ramming tank type, comprises an asymmetric member 20, for example a pierced valve creating a head loss on filling the hydro-pneumatic reservoir 3. A branch tube 21 is disposed between the pipe 1 and the hydro-pneumatic reservoir 3. The head loss created on filling the hydro-pneumatic reservoir 3 via the asymmetric member 20 causes a sufficient flow to pass into the tube 21 provided with a venturi tube 17 and an air introduction device 7 for the working pressure $P_s$ in the cylindrical portion of the venturi tube 17 to fall below atmospheric pressure and enable the introduction of air. The air introduction device 7 comprises an electric valve 9 open when a lack of air is to be made good and a check valve 16 to prevent liquid leaking out via the tube 8 when the hydro-pneumatic reservoir 3 is being filled with the electric valve 9 open.

The invention provides a device for introducing air into a hydro-pneumatic reservoir that is suitable for hydraulic systems of varied types, anti-ramming tanks, regulation reservoirs, that is of low cost and consumes little energy.

What is claimed is:

1. A device for introducing outer air into an hydraulic system in which a pipe is connected to a hydro-pneumatic reservoir is mounted on a pipe, said system having an area containing water in which the absolute pressure $P_s$ is below atmospheric pressure;

said device comprising a means for introducing air into said area of the system containing water in which the absolute pressure $P_s$ is below atmospheric pressure, said means being active only when there is a lack of air to be made good in the hydro-pneumatic reservoir; said means for introducing air into said area of the system including:

an air feed tube;

an electric valve for allowing and closing off air flow through said air feed tube; and, an air introduction flowrate limiter for controlling air flow in the air feed tube.

2. A device according to claim 1 wherein the air feed tube is equipped with air introduction monitoring means.

3. A device according to claim 1 in a system wherein the device is mounted between a water offtake and a pump which are on said pipe.

4. A device according to claim 3 in a system wherein the device is mounted upstream of said pump which has a low pressure area into which said air feed tube discharges.

5. A device according to claim 3 wherein the pump is a submerged pump which has an inlet strainer, said device being mounted upstream of said submerged pump, and said air feed tube discharging into said inlet strainer of the pump.

6. A device according to claim 1 in said system, wherein said pipe is provided with depressurizing means upstream of the hydro-pneumatic reservoir, and the air feed tube being connected to said depressurizing means.

7. A device according to claim 6 wherein the depressurizing means comprise a venturi tube.

8. A device according to claim 1 in said system, wherein the device includes a branch tube connected to a part of the hydro-pneumatic reservoir containing water, an auxiliary pump mounted on the branch tube and depressurizing means mounted downstream of the auxiliary pump, the air feed tube being connected to said depressurizing means.

9. A pump which includes a device as claimed in claim 1.

10. A hydro-pneumatic reservoir in combination with a device as claimed in claim 1.

11. A device for introducing outer air into an hydraulic system in which a pipe is connected to a hydro-pneumatic reservoir is mounted on a pipe, said system having an area containing water in which the absolute pressure $P_s$ is above atmospheric pressure;

said device comprising a means for introducing air into said area of the system containing water in which the absolute pressure $P_s$ is above atmospheric pressure, said means being active only when there is a lack of air to be made good in the hydro-pneumatic reservoir; said means for introducing air into said area of the system including:

an air feed tube;

an air introduction flowrate limiter connected to said air feed tube for controlling air flow in the air feed tube;

an air compressor for supplying air to said air feed tube and, a valve for allowing and closing off air flow through said air feed tube.

12. A device according to claim 11 wherein the air feed tube is equipped with air introduction monitoring means.

13. A device according to claim 11 in a system wherein the device is mounted between a water offtake and a pump which are on said pipe.

14. A device according to claim 13 in a system wherein the device is mounted upstream of said pump which has a low pressure area into which said air feed tube discharges.

15. A device according to claim 13 wherein the pump is a submerged pump which has an inlet strainer, said device being mounted upstream of said submerged pump, and said air feed tube discharging into said inlet strainer of the pump.

16. A device according to claim 11 in said system, wherein said pipe is provided with depressurizing means upstream of the hydro-pneumatic reservoir and the air feed tube being connected to said depressurizing means.

17. A device according to claim 16 wherein the depressurizing means comprise a venturi tube.

18. A device according to claim 11 in said system, wherein the device includes a branch tube connected to a part of the hydro-pneumatic reservoir containing water, an auxiliary pump mounted on the branch tube and depressurizing means mounted downstream of the auxiliary pump, the air feed tube being connected to said depressurizing means.

19. A pump which includes a device as claimed in claim 11.

20. A hydro-pneumatic reservoir in combination with a device as claimed in claim 11.

* * * * *